US008387847B2

(12) United States Patent
Hachisuka

(10) Patent No.: US 8,387,847 B2
(45) Date of Patent: Mar. 5, 2013

(54) POWER TOOL

(75) Inventor: Tomohiro Hachisuka, Anjo (JP)

(73) Assignee: Makita Corporation, Anjo-Shi (JP)

( * ) Notice: Subject to any disclaimer, the term of this patent is extended or adjusted under 35 U.S.C. 154(b) by 197 days.

(21) Appl. No.: 12/461,947

(22) Filed: Aug. 28, 2009

(65) Prior Publication Data

US 2010/0050830 A1 Mar. 4, 2010

(30) Foreign Application Priority Data

Sep. 2, 2008 (JP) ..... 2008-225310

(51) Int. Cl.
*B25G 1/10* (2006.01)

(52) U.S. Cl. ..... 227/156; 81/489; 16/430

(58) Field of Classification Search ..... 81/489–492; 173/171, 162.2, 170; 227/156; 16/430, DIG. 12; D8/80, 83, 94, 107, 68
See application file for complete search history.

(56) References Cited

U.S. PATENT DOCUMENTS

| | | | | |
|---|---|---|---|---|
| D324,801 | S * | 3/1992 | Caskey et al. | D8/68 |
| 5,097,566 | A * | 3/1992 | Decker et al. | 16/421 |
| 5,234,740 | A * | 8/1993 | Reeves et al. | 428/167 |
| 5,299,475 | A * | 4/1994 | Stroop | 81/489 |
| 5,491,015 | A * | 2/1996 | Reeves et al. | 428/167 |
| 6,237,193 | B1 * | 5/2001 | Skerker et al. | 16/430 |
| 6,308,378 | B1 * | 10/2001 | Mooty et al. | 16/430 |
| 6,332,381 | B1 * | 12/2001 | Vasudeva | 81/177.2 |
| 6,390,704 | B1 * | 5/2002 | Baudino et al. | 401/6 |
| 6,976,405 | B2 * | 12/2005 | Schaeffer | 81/3.55 |
| D525,848 | S * | 8/2006 | Kokawa | D8/68 |
| D527,971 | S * | 9/2006 | Kokawa | D8/68 |
| D539,110 | S * | 3/2007 | Okuda et al. | D8/68 |
| 7,496,989 | B2 * | 3/2009 | Walker et al. | 16/430 |
| 2005/0055835 | A1 | 3/2005 | Pardue et al. | |
| 2005/0166741 | A1 | 8/2005 | Kopras et al. | |
| 2006/0143866 | A1 * | 7/2006 | Lagaly et al. | 16/430 |
| 2006/0175069 | A1 * | 8/2006 | Sakakibara et al. | 173/217 |

FOREIGN PATENT DOCUMENTS

| | | |
|---|---|---|
| EP | 2 075 095 A2 | 7/2009 |
| JP | A-2002-254341 | 9/2002 |

OTHER PUBLICATIONS

Feb. 15, 2012 European Search Report issued in EP 09011228.5.

* cited by examiner

*Primary Examiner* — M. Alexandra Elve
*Assistant Examiner* — Andrew M Tecco
(74) *Attorney, Agent, or Firm* — Oliff & Berridge, PLC

(57) ABSTRACT

It is an object of the invention to provide a technique that contributes to improved gripping characteristics in a hand-held power tool. A power tool for performing a predetermined operation by driving a tool bit includes a tool body 101 and a handgrip 103 formed on the tool body 101. The handgrip 103 has a plurality of ribs 117 formed in parallel on a grip face which is held by user's fingers and protruding from the grip face. The ribs 117 extend along a contour of the grip face in a longitudinal direction of the handgrip, and in the circumferential direction of the handgrip 103, each of the ribs 117 has a ridged shape which is engaged in one direction but not engaged in the other direction with balls of fingertips of at least third to fifth fingers of the user's hand.

16 Claims, 8 Drawing Sheets

POWER TOOL

BACKGROUND OF THE INVENTION

1. Field of the Invention

The invention relates to a hand-held power tool which performs a predetermined operation on a workpiece and more particularly, to an improved technique of the handgrip.

2. Description of the Related Art

Japanese non-examined laid-open Patent Publication No. 2002-254341 discloses a hand-held power tool in which a tool bit is driven by an electric motor. The known power tool includes a body, a tool bit mounted to the tip end region of the body, an electric motor housed within the body to drive the tool bit and a handgrip that extends from its joint end on the side of the body to its distal end in a direction transverse to the axial direction of the tool bit.

When operating the power tool to perform an operation on a workpiece by the tool bit while holding the handgrip, ease of gripping the handgrip is desired to alleviate fatigue of the user holding the handgrip. Particularly, if the grip is easy to slip, a stronger grip force is necessarily required and it increase burden of the user.

SUMMARY OF THE INVENTION

Accordingly, it is an object of the invention to provide a technique to improve gripping characteristics in a hand-held power tool.

Above-described problem can be solved by a representative embodiment according to the invention. The representative power tool to perform a predetermined operation by driving a tool bit includes a tool body and a handgrip formed on the tool body. The representative power tool according to the invention may widely embrace various kinds of power tools such as a driving machine for driving nails or staples, an electric planer for planing a workpiece surface, a hammer drill for drilling or chipping a workpiece and a router for chamfering or cutting out a workpiece.

According to the preferred embodiment of the invention, the handgrip has a plurality of ribs formed in parallel on a grip face to protrude from the grip face. Each rib extends on the grip face in a longitudinal direction of the handgrip. Each rib has a ridged shape which can be engaged with balls of fingertips of at least third to fifth fingers of the user's hand holding the handgrip in one direction of the circumferential directions of the handgrip. On the other hand, the ridged shape does not allow the rib to engage in the other direction of the circumferential directions of the handgrip with balls of fingertips of at least third to fifth fingers of the user's hand holding the handgrip. The one direction here may preferably represent the direction toward the bases from the fingertips of the third to fifth fingers, while the other direction may preferably represent the direction toward the fingertips from the base of the third to fifth fingers.

It is important for the handgrip to have easy-to-grip and hard-to-slip gripping characteristics. Having regard to the process of holding the handgrip by fingers, the balls of the fingers contact the grip face in sequence from the base side to the fingertip side. In this respect, according to the invention, each of the ribs is shaped no to allow the engagement or hard to be engaged with the balls of the fingertips in the other direction in the circumferential direction of the handgrip. With this configuration, the user can hold the handgrip without resistance upon the balls of the fingertips, so that ease of grip can be provided. On the other hand, in the direction toward the bases from the fingertips of the grip holding fingers, the rib is shaped to be engaged with the balls of the fingertips. With this configuration, the rib can serve as a slip stopper so that the grip force can be improved. As a result, the user is allowed to lightly hold the handgrip during operation so that user's fatigue can be lessened.

In a further embodiment of the power tool according to the invention, each of the ribs has a triangularly shaped cross-section having sides formed by inclined surfaces extending from the grip face to an apex. One of the inclined surfaces is shorter than the other inclined surface. The inclined surfaces are not necessarily required to be flat, but they may be curved.

According to the invention, by provision of the ribs having the sectional shape designed as described above, each rib may have a ridged shape which can be engaged in one direction but never engaged or hard to be engaged in the other direction with balls of fingertips of at least third to fifth fingers of the grip holding fingers.

In a further embodiment of the power tool according to the invention, when the longitudinal direction of the tool body is set in a horizontal position, the center of gravity of the power tool is located above and in front of the handgrip in a direction in which a second finger extends when straightened from its grip holding position. The power tool having such a construction may include a driving machine for driving nails or staples and a hammer drill for drilling or chipping a workpiece. Further, the handgrip may extend in a direction to cross the longitudinal direction of the tool body to have end regions in the longitudinal direction and a slip stopper may be provided in a rear face region of the end regions which is held in contact with a ball of a little finger of the grip holding fingers of the user. The slip stopper may be formed specifically by making the circumferential length of the end region including the rear face region of the handgrip longer than that of a central region located inward of the end region. In other words, it is formed by making the grip diameter of the end region larger than that of the central region, or by forming a bulge in the rear face region.

In the case of the power tool of which center of gravity is located above and in front of the handgrip as viewed from the handgrip side toward the tool bit when the longitudinal direction of the tool body is set in a horizontal position, moment may possibly act during the operation upon the power tool in the direction that rotates the front (the tool bit side) of the power tool downward around the handgrip. As a result, a force is applied to the ball of the little finger of the grip holding fingers which is held in contact with the rear face region of the handgrip, in a direction that pushes it rearward. According to the invention, by provision of the slip stopper in the rear face region which is held in contact with the ball of the little finger of the grip holding fingers, the ball of the little finger is rendered hard to slip on the grip face so that it can securely support the power tool.

In a further embodiment of the power tool according to this invention, the handgrip extends in a direction transverse to the longitudinal direction of the tool body and has end regions in the longitudinal direction, and in one of the end regions on the side of a first finger of the grip holding fingers, a first-finger set point on which a ball of the first finger is placed is formed by recessing the grip face. With this configuration, the first finger is rendered hard to slip, so that the gripping characteristics can be improved.

Other objects, features and advantages of the invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tools and method for using such power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
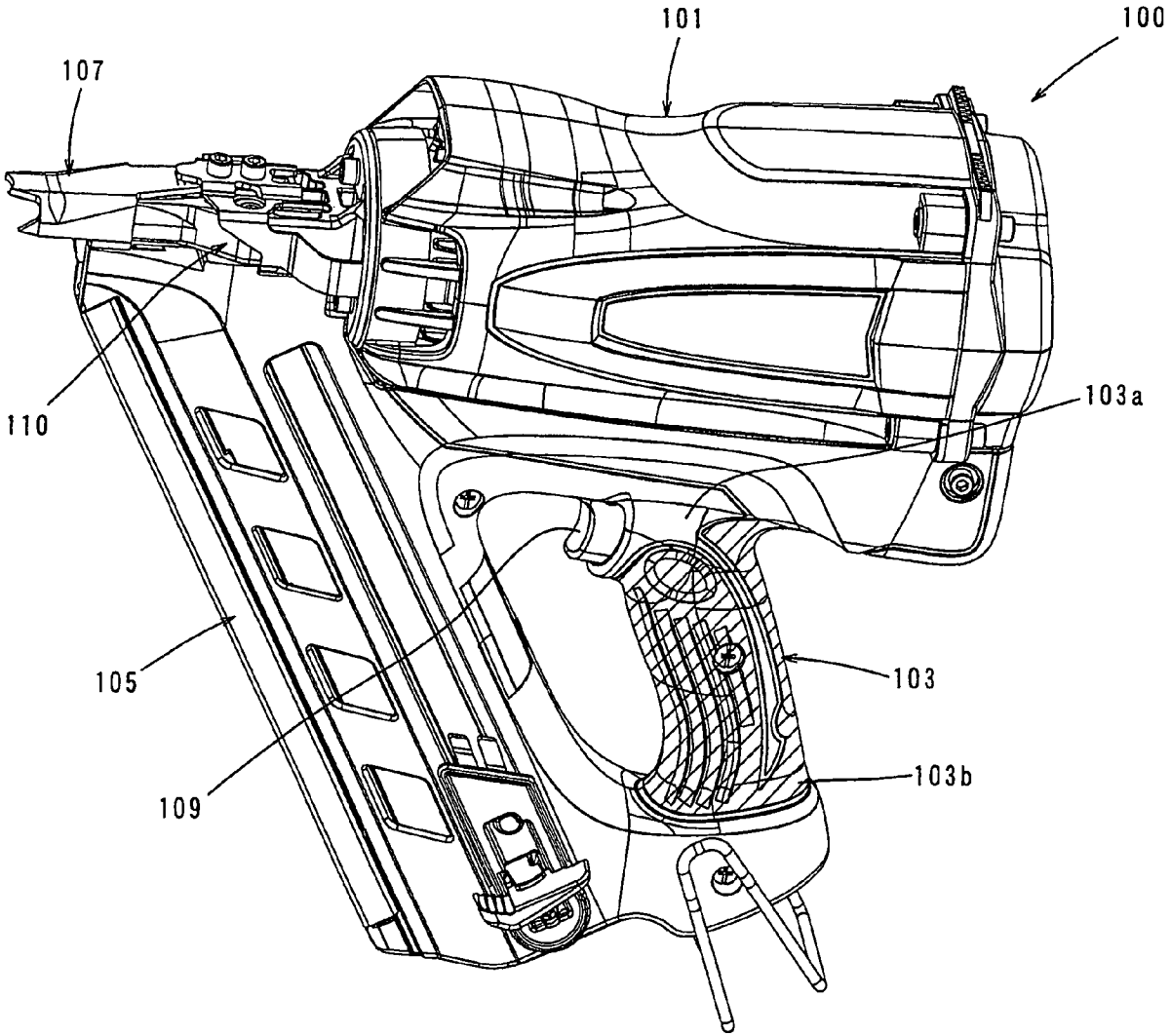
FIG. 1 is a perspective view showing the entire structure of a nailing machine 100 according to a first embodiment of the invention.
Figure 2:
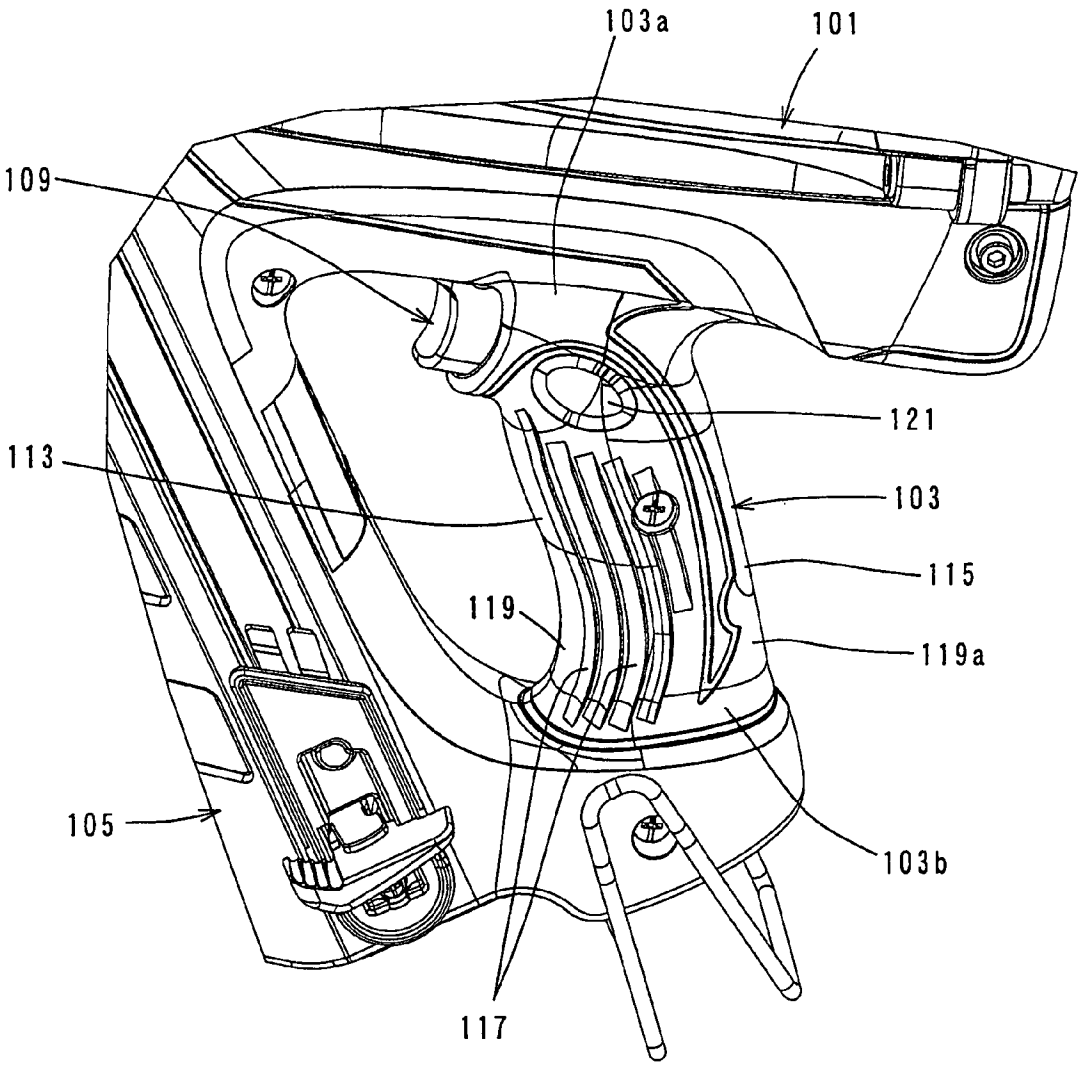
FIG. 2 is a perspective external view showing a handgrip 103.
Figure 3:
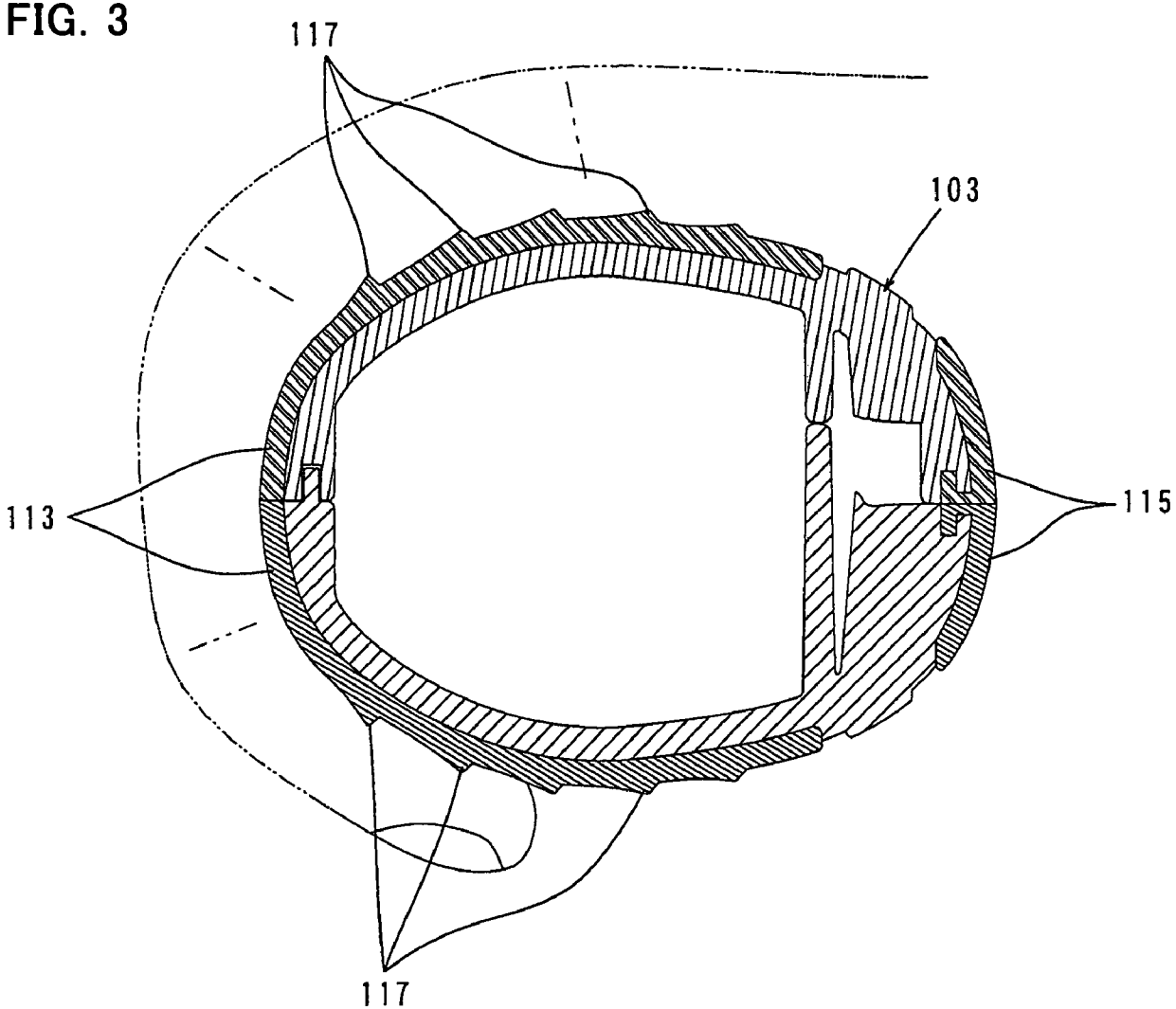
FIG. 3 is a sectional view showing the sectional shape of the handgrip 103.
Figure 4:
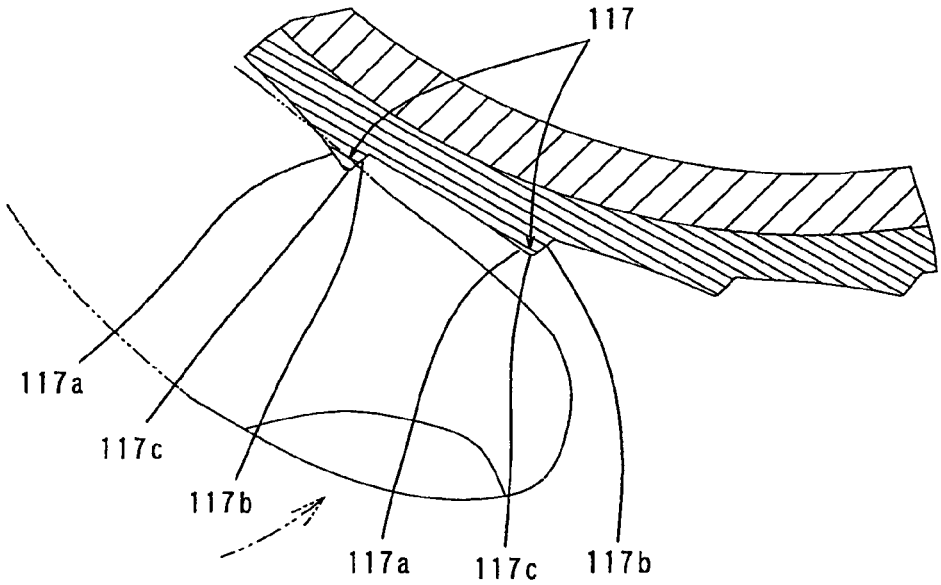
FIG. 4 is a sectional view showing the sectional shape of ribs 117 formed on the handgrip 103.
Figure 5:
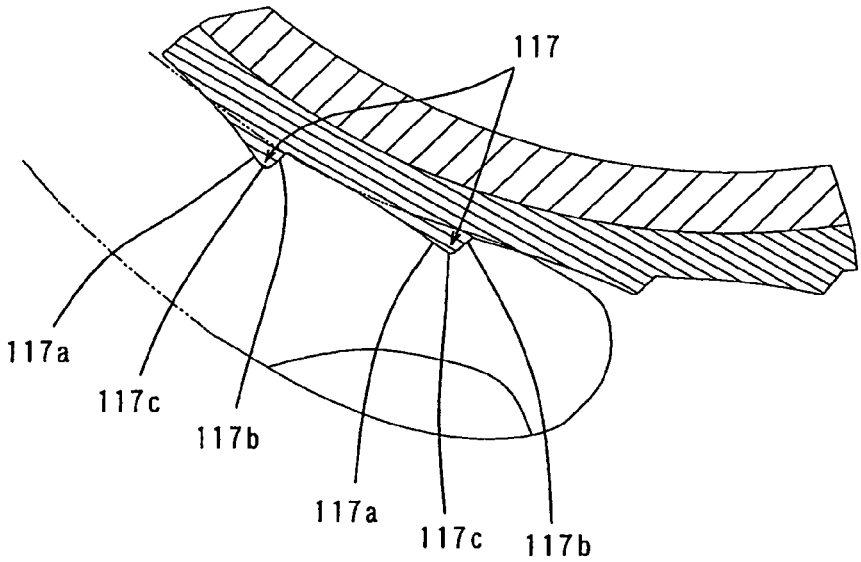
FIG. 5 is a sectional view showing the sectional shape of the ribs 117 formed on the handgrip 103.

A first embodiment of the invention is now described with reference to attached drawings. First embodiment refers to a gas combustion nailing machine as a representative example of a power tool according to the invention. FIG. 1 is an external view showing the entire structure of a nailing machine 100 according to this embodiment. FIG. 2 is an enlarged external view showing a handgrip 103. Further, FIG. 3 is a sectional view showing the sectional shape of the handgrip 103, and FIGS. 4 and 5 are enlarged views each showing the sectional shape of ribs 117 formed on the handgrip 103.

As shown in FIG. 1, the nailing machine 100 according to this embodiment includes a body 101, a nail ejection part 110 formed on the tip of the body 101 in the longitudinal direction, a handgrip 103 (handle) connected to the body 101 and arranged to be held by a user, a magazine 105 loaded with nails as materials to be driven in, and a nail-driving driver bit arranged within the body 101 (not particularly shown). The body 101 and the driver bit are features that respectively correspond to the "tool body" and the "tool bit" according to this invention. In FIG. 1, the tip of the body 101 is shown pointed upon a workpiece. Accordingly, in FIG. 1, the horizontal direction is a nail driving direction (the longitudinal direction of the body 101) and a nail striking direction in which the driver bit strikes the nail. In the following description, the side of the nail ejection part 110 (the left side as viewed in FIG. 1) is taken as the front side, and the opposite side (the right side as viewed in FIG. 1) as the rear side.

The body 101 is mainly formed by a housing, and the housing houses a gas combustion chamber, an igniter, a fuel injector, a drive unit, etc., which are not shown. Gas is supplied from a fuel tank (gas cylinder) to the gas combustion chamber via the fuel injector, and the gas is mixed with air in the gas combustion chamber. Thereafter, the mixed gas is burned by ignition of the igniter. By combustion energy generated by this combustion, a piston which is a component part of the driving unit is linearly driven toward the tip of the body 101. The driver bit is designed to move together with the piston in one piece and to drive a nail into a workpiece by linearly moving forward together with the piston. The nail ejection part 110 is formed on the tip of the body 101 (on the left as viewed in FIG. 1) and serves to guide the nail driving movement of the driver bit and forms a nail ejection port.

The magazine 105 is mounted to extend between the tip of the body 101 and the end of the handgrip 103, and one end of the magazine 105 (on the nail feeding side) is connected to the nail ejection part 110. The magazine 105 contains numerous nails connected with each other and feeds one nail to be driven next into the ejection part 110 upon each nail driving movement of the driver bit.

A contact arm 107 is provided on the tip of the ejection part 110. The contact arm 107 can slide with respect to the ejection part 110 in the longitudinal direction of the ejection part 110 (the longitudinal direction of the nailing machine 100 and the nail driving direction of the driver bit) and is normally biased forward to the tip side (to the left as viewed in FIG. 1) by a biasing means. When the tip of the contact arm 107 is pressed against the workpiece and moved rearward to the body 101 side, the contact arm 107 hermetically closes the gas combustion chamber with respect to the outside and thus creates a condition that allows gas combustion in the gas combustion chamber.

The handgrip 103 is held by a user to perform an operation or to carry the nailing machine. FIG. 2 is an enlarged perspective view showing the handgrip 103. The handgrip 103 extends from a grip proximal end 103*a* which is contiguous to the sides of the body 101 to a grip distal end 103*b* in a direction to cross the longitudinal direction of the driver bit (the longitudinal direction of the body 101). Specifically, provided that the body 101 of the nailing machine 100 is oriented such that the nail driving direction is the horizontal direction as shown in FIG. 1, the handgrip 103 extends downward from the grip proximal end 103*a* to the grip distal end 103*b* and is connected at the extending end or the grip distal end 103*b* to the other end of the magazine 105. Thus, the handgrip 103 is integrated with the body 103 and the magazine 105. The handgrip 103 is a feature that corresponds to the "handgrip" according to this invention.

A trigger 109 as a corresponding feature of an operating member is disposed near the grip proximal end 103*a* in a front surface region of the handgrip 103. The trigger 109 can be depressed by a user of the nailing machine 100. By depressing the trigger 109, the fuel injector and the igniter are actuated. Specifically, fuel in the fuel tank is supplied into the gas combustion chamber via the fuel injector, and at a predetermined time interval thereafter, it is ignited by the igniter.

In the nailing machine 100 having the above-described construction, when the user presses the contact arm 107 against the workpiece and then depresses the trigger 109 while holding the handgrip 103 with one hand, the nailing machine 100 is actuated and the driver bit performs a nail driving movement. The operating principle of the gas combustion nailing machine 100 as itself pertains to a known art and therefore its construction and operation will not be described in further detail.

As shown in the sectional view of FIG. 3, the handgrip 103 has an elliptical shape having a major axis in its fore-and-aft direction and a minor axis in a direction (sidewise direction) to cross the fore-and-aft direction. User's finger holding the handgrip is shown by two-dot chain line. The handgrip 103 has a shell made of hard material (hard synthetic resin material or other similar material). A cushion of soft material (soft synthetic resin material or rubber material) which is softer than the hard material is further provided around the shell. The cushion is shown diagonally shaded in FIG. 1 and includes a grip front contact portion 113 and a grip rear contact portion 115. The grip front contact portion 113 is formed on the front and side surfaces of the handgrip 103 and the grip rear contact portion 115 is formed on the rear surface of the handgrip 103. By provision of the cushion having such a construction, the handgrip 103 can provide a soft feel of grip for the user who holds the handgrip 103 and performs a nailing operation.

The handgrip 103 has a length in its longitudinal direction (a vertical direction of the nailing machine 100 placed in a horizontal position) which is long enough to hold by one hand. Further, the handgrip 103 has such a large thickness that a space of about 1 cm is provided between the fingertip of the first finger (thumb) and the fingertip of the second finger (index finger) of the user's grip holding hand.

A grip face of the handgrip 103 or a greater part of the outer surface of the handgrip 103 is formed by the cushion. A plurality of anti-slip ribs 117 are provided on the outer surface of the grip front contact portion 113 which forms the cushion and arranged generally equidistantly in the circumferential direction. The ribs 117 extend in parallel along the longitudinal direction of the handgrip 103. The ribs 117 are features that correspond to the "ribs" according to this invention. In this embodiment, the ribs 117 are formed in a region of the grip face (outer surface) of the grip front contact portion 113 in which the fingertips of a third finger (middle finger), a fourth finger (ring finger) and a fifth finger (little finger) of the user's hand are positioned when holding the handgrip. Specifically, the ribs 117 are formed on the right and left sides of the grip front contact portion 113, which allows both right-handed grip and left-handed grip.

It is important for the handgrip 103 to have easy-to-grip and hard-to-slip gripping characteristics. From this viewpoint, in this embodiment, the intervals between the ribs 117 in the circumferential direction are set within a range from such an extent that the balls of the user's fingers can be held in contact with the grip face (outer surface) to such an extent that the fingertips can be engaged with the ribs 117 without fail when holding the handgrip.

Further, as shown in FIGS. 4 and 5, each of the ribs 117 has a ridged shape which is engaged in one direction but not engaged or hard to be engaged in the other direction with the balls of the fingertips of the third to fifth fingers of the user when the user holds the handgrip 103. Specifically, in this embodiment, the rib 117 has a section of a generally scalene triangular shape in a direction transverse to the extending direction, having one side formed by a gently inclined surface 117*a* and the other side formed by a steeply inclined surface 117*b* in the circumferential direction of the handgrip 103. In other words, the scalene sides of the rib 117 extend from an apex 117*c* to the grip face and one of the sides (steeply inclined surface 117*b*) is shorter than the other side (gently inclined surface 117*a*) in the circumferential direction of the handgrip 103. The ridged shape is formed such that the fingertip sides of the third to fifth fingers of the grip holding fingers are located on the steeply inclined surface 117*b* and the base sides of the third to fifth fingers are located on the gently inclined surface 117*a*. Therefore, as shown in FIG. 3, the gently inclined surface 117*a* and the steeply inclined surface 117*b* of each of the ribs 117 on one side (lower side as viewed in FIG. 3) of the grip front contact portion 113 are designed to be opposite in orientation to those of the rib 117 on the other side (upper side as viewed in FIG. 3). Thus, the same conditions are provided for the right-handed grip and the left-handed grip. The steeply inclined surface 117*b* and the gently inclined surface 117*a* are features that correspond to the "one inclined surface" and the "other inclined surface", respectively, according to this invention.

By provision of the ribs 117 having the sectional shape designed as described above, when the third to fifth fingers are slid around the longitudinal direction of the handgrip 103 (in the circumferential direction of the grip face), the fingertips are not allowed to be engaged with the ribs 117 in the direction of forward movement and engaged in the direction of backward movement.

Considering the process of holding (gripping) the handgrip 103 by fingers, as shown in FIGS. 4 and 5, the balls of the fingers contact the grip face of the handgrip 103 in sequence from the base side to the fingertip side. Therefore, each of the ribs 117 is shaped not to be engaged or hard to be engaged with the balls of the fingertips, or has the gently inclined surface 117*a*, in the direction toward the fingertips from the bases of the user's fingers holding the handgrip 103. With this configuration, the user can hold the handgrip without resistance upon the balls of the fingertips, so that ease of grip can be provided. On the other hand, in the direction of the bases from the fingertips of the user's fingers holding the handgrip 103, the rib 117 is shaped to be engaged with the balls of the fingertips, or has the steeply inclined surface 117*b*. With this configuration, the rib 117 can serve as a slip stopper so that the grip force can be improved and as a result, the user is allowed to lightly hold the handgrip 103 during operation.

Specifically, by provision of the rib 117 which has a section of a scalene triangular shape having one side formed by the gently inclined surface 117*a* and the other side formed by the steeply inclined surface 117*b*, the handgrip 103 can be made easy to grip and hard to slip, so that the gripping characteristics can be improved. The ratio of the length of the one side or the gently inclined surface 117*a* to the length of the other side or the steeply inclined surface 117*b* of the rib 117 may be determined by considering easy-to-grip and hard-to-slip gripping characteristics. Further, preferably, an area where the gently inclined surface 117*a* and the steeply inclined surface 117*b* meet or the apex 117*c* of the rib 117 is appropriately round chamfered so as not to cause pain in the user's fingers. Further, the gently inclined surface 117*a* and the steeply inclined surface 117*b* are not necessarily required to be flat, but they may be curved.

Further, a region held in contact with a greater part of the palm of user and an outer surface of the grip rear contact portion 115 are not provided with any rib 117. Such a smooth arcuate outer surface of the grip rear contact portion 115 provides a gentle feel for the palm.

Further, as shown in FIG. 2, an end grip region located slightly inward of the grip distal end 103*b* and more specifically, a grip end region 119 including a little-finger ball contact region (rear face region) 119*a* has a circumferential length longer (or grip diameter larger) than that of a region located inward of the grip end region 119. Thus, with the configuration in which the grip end region 119 including the little-finger ball contact region 119*a* has a longer circumferential length, moment (frontal dangling) acting upon the nailing machine 100 can be effectively coped with in the grip holding state.

According to the representative nailing machine 100, the center of gravity of the entire nailing machine is located above and in front of the handgrip 103 on the body 101 side. Therefore, for example, when the user performs a nailing operation while holding the handgrip 103, moment acts upon the nailing machine 100 in the horizontal position in the direction that lowers the front of the body 101 or that causes frontal dangling. According to the representative embodiment, by provision of the larger-diameter grip end region 119 including the little-finger ball contact region 119*a*, the ball of the little finger is rendered hard to slip so that it can effectively support the above-described moment. The provision of the larger-diameter grip end region 119 corresponds to the "provision of a slip stopper in a rear surface region" according to this invention.

Further, in depressing the trigger 109 in the front surface region of the grip proximal end 103*a* of the handgrip 103 by the user's second finger in the nailing operation using the nailing machine 100, ease of operation depends on whether the first finger is hard to slip or not. In this embodiment, as shown in FIGS. 1 and 2, a first-finger set point 121 is formed in the side of the grip front contact portion 113. The first-finger set point 121 is a recess formed in the grip face and having an elliptical shape relatively long in the fore-and-aft direction. Further, the surface of the recess is grained. The first-finger set point 121 is arranged on extensions of the ribs 117 in the extending direction.

As described above, by provision of the first-finger set point 121 formed by recessing the grip face, the first finger can be rendered hard to slip so that ease of operation in depressing the trigger 109 by the second finger can be enhanced.

Further, if a region of the grip face with which a web part between the first and second fingers is held in contact when holding the handgrip has a small grip diameter, the user may suffer pain in the web part in continuous operation. Therefore, this region is also configured to have a larger grip diameter than the other region of the grip face in order to prevent the user from suffering pain in the web part.

Second Embodiment

Figure 6:
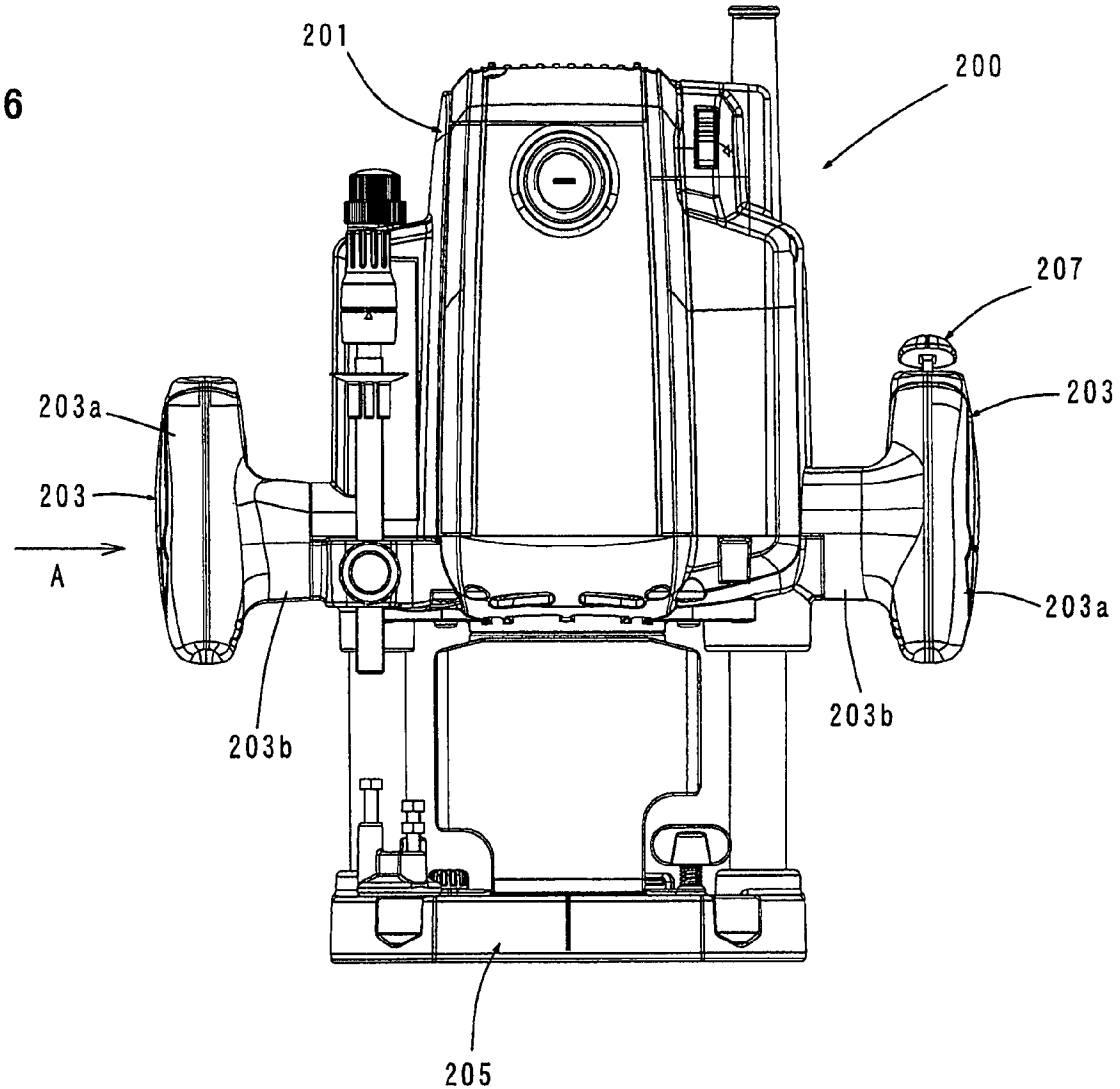
FIG. 6 is a front view showing the entire structure of an electric router 200 according to a second embodiment of the invention.

A second embodiment of the invention is now described with reference to FIGS. 6 to 12. In this embodiment, an electric router 200 for performing chamfering, cutting-out or other similar operations on a workpiece has a pair of ear-shaped handgrips 203 each having ribs 217. FIG. 6 is a front view showing the entire electric router 200.

As shown in FIG. 6, the electric router 200 includes a table 205 which can be placed on a workpiece, and a router body 201 mounted in vertical orientation on the table 205. Within the router body 201, an electric motor is vertically oriented with an output shaft pointed downward, which is not shown. A bit holder for holding a tool bit in the form of a router bit is mounted on the output shaft of the motor. The router body 201 and the router bit are features that respectively correspond to the "tool body" and the "tool bit" according to the invention. The pair of handgrips 203 are formed on the right and left sides of the router body 201. The detailed construction of the electric router 200 is not directly related to the invention and will not be further described.

In order to perform an operation by the router bit of the electric router 200 constructed as described above, the handgrips 203 are held and the table 205 is placed on the workpiece and slid in the longitudinal and transverse directions.

The right and left handgrips 203 according to the embodiment are generally T-shaped in horizontal orientation as viewed from the front or the back. Further, an operating member 207 is provided on one (right one as viewed in FIG. 6) of the handgrips 203 and operated to turn on and off an electrical switch for electrically driving the motor.

Figure 7:
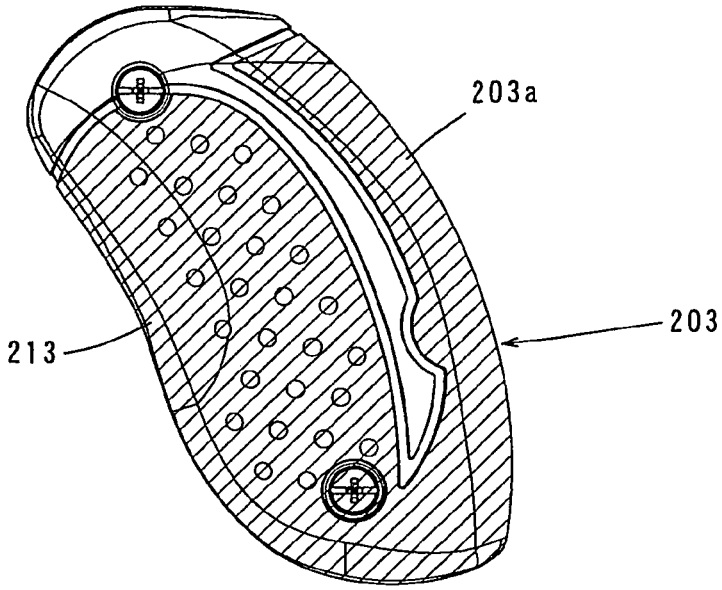
FIG. 7 is a front view of a handgrip 203 as viewed from the direction of an arrow A in FIG. 6.
Figure 8:
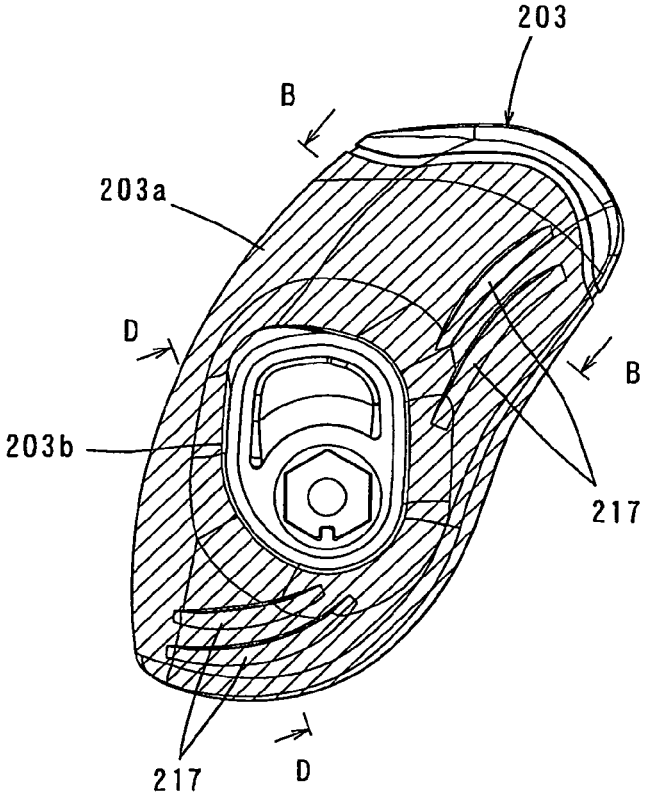
FIG. 8 is a rear view of the handgrip 203 as viewed from the direction opposite to the direction of the arrow A in FIG. 6.
Figure 9:
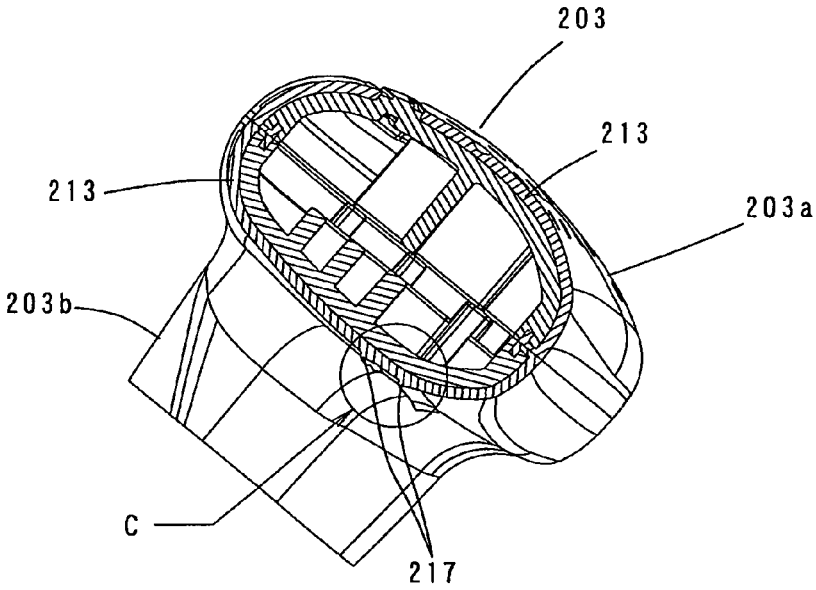
FIG. 9 is a sectional view taken along line B-B in FIG. 8.
Figure 10:
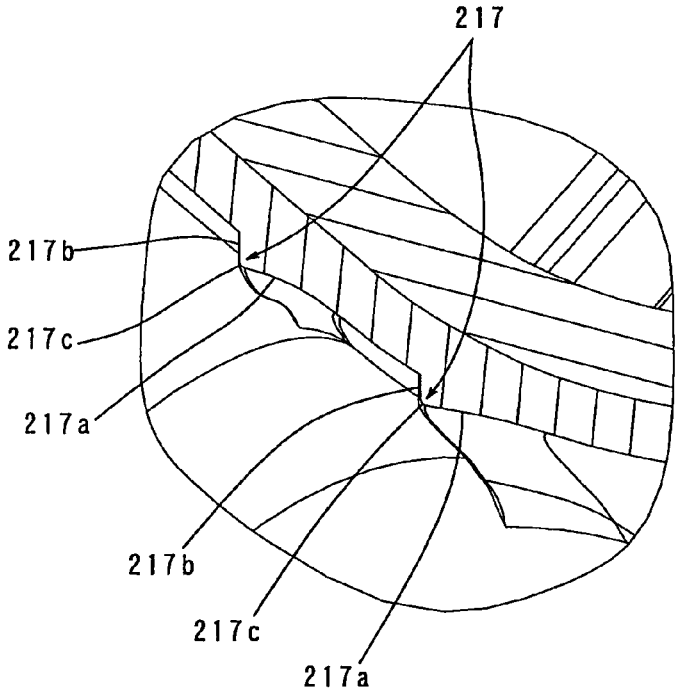
FIG. 10 is an enlarged view of part C in FIG. 9.
Figure 11:
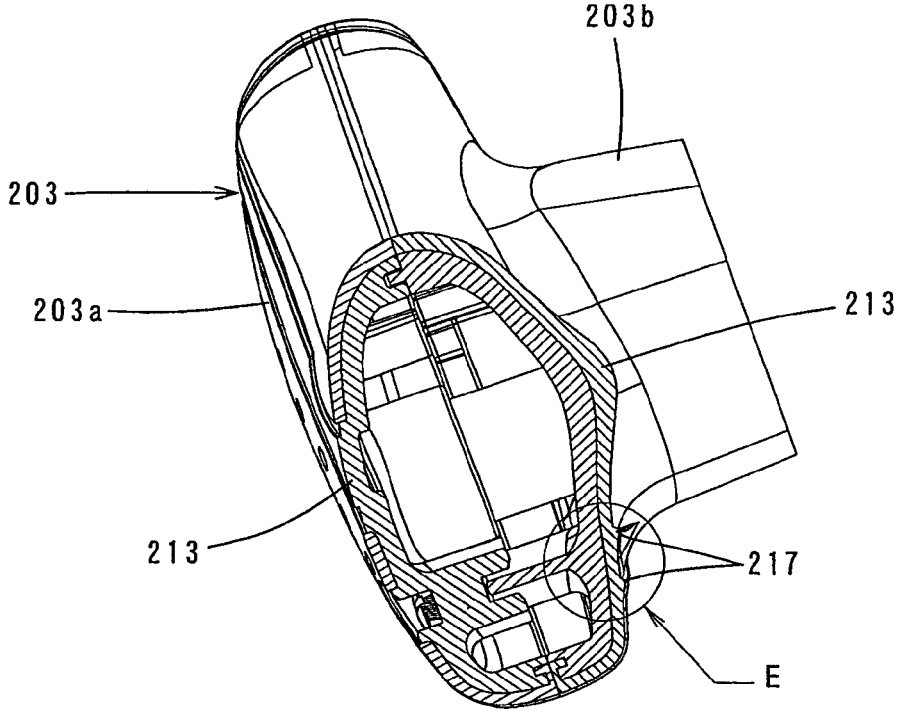
FIG. 11 is a sectional view taken along line D-D in FIG. 8.
Figure 12:
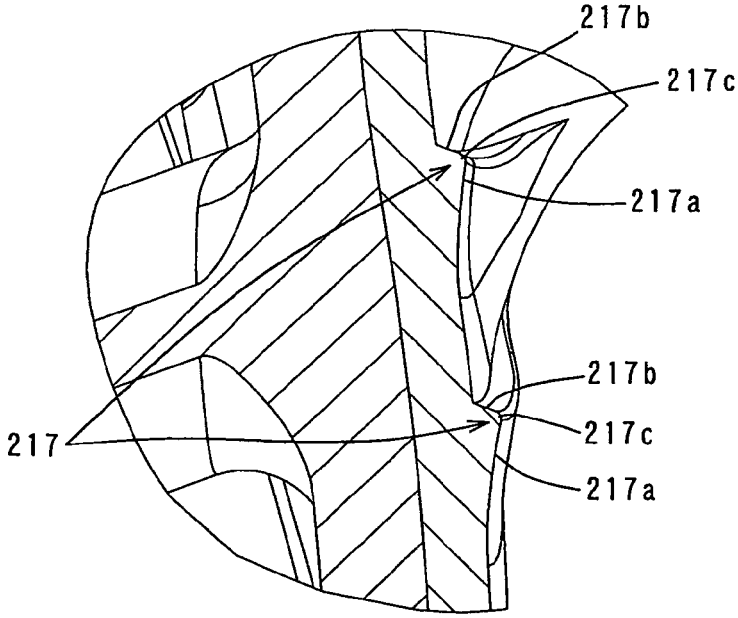
FIG. 12 is an enlarged view of part E in FIG. 11.

The construction of the handgrip 203 is now explained with reference to FIGS. 7 to 12. FIG. 7 is a front view of the handgrip 203 as viewed from the direction of an arrow A in FIG. 6, and FIG. 8 is a rear view thereof. FIG. 9 is a sectional view taken along line B-B in FIG. 8, and FIG. 10 is an enlarged view of part C in FIG. 9. FIG. 11 is a sectional view taken along line D-D in FIG. 8, and FIG. 12 is an enlarged view of part E in FIG. 11.

The handgrip 203 is T-shaped, having a grip region in the form of a part 203*a* corresponding to the head of the T-shape and a mounting part in the form of a part 203*b* corresponding to the leg of the T-shape (see FIG. 6). The T-shaped handgrip 203 is held in such a manner that the grip region or the part 203*a* corresponding to the head of the T-shape is wrapped by the user's palm. Therefore, like in the above-described first embodiment, the grip face of the handgrip 203 has a shell made of hard material (hard synthetic resin material or other similar material) and a cushion in the form of a grip contact portion 213 made of soft material (soft synthetic resin material or rubber material) which is softer than the hard material and provided around the shell (see FIGS. 7 to 9 and 11). The cushion is shown diagonally shaded in FIGS. 7 and 8. By provision of such a cushion, the handgrip 203 can provide a soft feel of grip for the user who holds the handgrip 203 and performs an operation by using the electric router 200.

In the case of the handgrip 203 of the type that is held in such a manner that the grip region corresponding to the head of the T-shape is wrapped by the palm, the fingertips of the second to fifth fingers reach onto the back of the back side of the grip contact portion 213 when holding the handgrip. Therefore, a plurality of ribs 217 are formed in parallel in the back region of the grip contact portion 213 which is held in contact with the fingertips of the grip holding fingers (see FIGS. 8, 9 and 11). When the extending direction of the grip holding fingers is defined as the circumferential direction of the handgrip 203, the ribs 217 extend along the contour of the grip face in a longitudinal direction of the handgrip 203. The ribs 217 are formed in the grip region on the both sides of the part 203*b* corresponding to the leg of the handgrip or extend discontinuously in the extending direction.

Each of the ribs 217 has the same sectional shape as the ribs of the above-described first embodiment in a direction transverse to the extending direction. Specifically, as shown in FIGS. 10 to 12, the rib 217 has a ridged shape or has a section of a scalene triangular shape in a direction transverse to the extending direction, having one side formed by a gently inclined surface 217*a* and the other side formed by a steeply inclined surface 217*b* in the circumferential direction of the handgrip 203. In other words, the scalene sides of the rib 117 extend from an apex 217*c* to the grip face and one of the sides (steeply inclined surface 217*b*) is shorter than the other side (gently inclined surface 217*a*) in the circumferential direction of the handgrip 203. The ridged shape is formed such that the fingertip sides of the second to fifth fingers of the grip holding fingers are located on the steeply inclined surface 217*b* and the base sides of the second to fifth fingers are located on the gently inclined surface 217*a*. The steeply inclined surface 217*b* and the gently inclined surface 217*a* are features that correspond to the "one inclined surface" and the "other inclined surface", respectively, according to this invention.

Therefore, according to this invention, by provision of the rib 217 which has a section of a scalene triangular shape having one side formed by the gently inclined surface 217*a* and the other side formed by the steeply inclined surface 217*b*, the rib 217 has a ridged shape which is engaged in one direction but never engaged or hard to be engaged in the other direction with the balls of the fingertips when the user holds the handgrip 203. With this configuration, the handgrip 203 can obtain improved gripping characteristics as being easy to grip and hard to slip.

Although, in the above-described embodiments, the ribs 117, 217 are each described as being formed on the respective cushions of the handgrips 103, 203 which are made of soft material, the cushions may be dispensed with and the ribs may be formed on the respective shells of the handgrips 103, 203 which are made of hard material.

Further, although, in the above-described embodiments, the invention is described as being applied to the handgrip 103 of the nailing machine 100 and to the handgrip 203 of the electric router 200, its applicability is not limited to them.

DESCRIPTION OF NUMERALS

100 nailing machine (power tool)
101 body (tool body)
103 handgrip
103*a* grip proximal end
103*b* grip distal end
105 magazine
107 contact arm
109 trigger
110 nail ejection part
113 grip front contact portion
115 grip rear contact portion
117 rib
117*a* gently inclined surface (the other inclined surface)
117*b* steeply inclined surface (one inclined surface)
117*c* apex
119 grip end region
119*a* little-finger ball contact region (rear face region)
121 first-finger set point
200 electric router (power tool)
201 router body (tool body)
203 handgrip
203*a* part corresponding to a head of the T-shape
203*b* part corresponding to a leg of the T-shape
205 table
213 grip contact portion
217 rib
217*a* gently inclined surface (the other inclined surface)
217*b* steeply inclined surface (one inclined surface)
217*c* apex

I claim:

1. A power tool that performs a predetermined operation by driving a tool bit comprising:

a tool body having a tool bit end located in a forward position;

a handgrip formed on the tool body, the handgrip having a shell made of a relatively hard material, and having an outer cushion made of a relatively softer material that is provided around at least a portion of the shell on the handgrip for engaging a user's fingers, a grip face provided on a circumferential surface of the handgrip and a plurality of ribs that are formed as a part of the cushion and are formed in parallel on the grip face to protrude from the grip face, wherein each rib is elongate and has a longitudinal dimension extending in the longitudinal direction of the handgrip that is greater than a circumferential dimension extending in the circumferential direction of the handgrip, and each rib has a ridged shape that is configured to provide enhanced gripping with balls of fingertips of at least third to fifth fingers of a user's hand holding the handgrip in one of the circumferential directions of the handgrip as compared to holding the handgrip in another direction of the circumferential directions, and each rib has a triangular shaped cross section and the triangular shape has sides formed by inclined surfaces extending from the grip face to an apex, one of the inclined surfaces being shorter than the other inclined surface, wherein the plurality of ribs are arranged on at least one of a left circumferential side and a right circumferential side of the handgrip and wherein the cushion is arranged on the handgrip to extend continuously at least from a rib that is located at a forward position on the handgrip along the circumferential side to a rib that is located at a comparatively more rearward position of the handgrip along the circumferential side, such that the cushion spans the forwardly positioned rib and the rearwardly positioned rib and the space therebetween.

2. The power tool as defined in claim 1, wherein, when the longitudinal direction of the tool body is set in a horizontal position, the center of gravity of the power tool is located above and in front of the handgrip in a direction in which a second finger extends when straightened from its grip holding position and wherein the handgrip extends in a direction transverse to the longitudinal direction of the tool body to have end regions in the longitudinal direction and wherein a slip stopper is provided in a rear face region of the end regions which is configured to be held in contact with a ball of a little finger of user's hand holding the handgrip.

3. The power tool as defined in claim 2, wherein the slip stopper is configured to be in contact with the ball of the little finger of the user's hand holding the handgrip and wherein the slip stopper is provided by making a circumferential length of the end region including the rear face region longer than that of a central region located inward of the end region.

4. The power tool as defined in claim 1, wherein the handgrip is provided to extend in a direction to cross the longitudinal direction of the tool body, the handgrip having end regions in the longitudinal direction, wherein a finger set point for placing a ball of the first finger is provided in one of the end regions to which first finger of the user's hand is set, the finger set being formed by recessing the grip face.

5. The power tool as defined in claim 1, wherein the handgrip has an elongated form and the ribs extend uninterrupted on the handgrip.

6. The power tool as defined in claim 1, wherein the handgrip has a T-shape and the ribs are arranged on the both sides of a leg of the T-shape.

7. The power tool as defined in claim 1, wherein the plurality of ribs are arranged on the handgrip such that the longitudinal dimension of the forwardly positioned rib is longer than the longitudinal dimension of the rearwardly positioned rib.

8. The power tool as defined in claim 7, wherein the longitudinal dimensions of the ribs become progressively longer toward the forward position along the circumferential side of the handgrip.

9. The power tool as defined in claim 1, wherein a portion of the shell at a rearward position on the handgrip along the circumferential side is not covered by the cushion.

10. The power tool as defined in claim 9, wherein the cushion covers a rear grip contact portion of the handgrip that is configured to engage the user's palm, and wherein the portion of the shell that is uncovered by the cushion at the rearward position is located between the rear grip contact portion and the rearwardly positioned rib.

11. A power tool that performs a predetermined operation by driving a tool bit comprising:

a tool body having a tool bit end located in a forward position;

a handgrip formed on the tool body, the handgrip having a shell made of a relatively hard material, and having an outer cushion made of a relatively softer material that is provided around at least a portion of the shell on the handgrip for engaging a user's fingers, a grip face provided on a circumferential surface of the handgrip, and a plurality of ribs that are formed as a part of the cushion on the grip face protruding from the grip face, each rib being elongate and having a longitudinal dimension extending in the longitudinal direction of the handgrip that is greater than a circumferential dimension extending in the circumferential direction of the handgrip and each rib having a ridged shape that includes, in a direction transverse to the longitudinal direction, a triangular shaped cross section and the triangular shape has sides formed by inclined surfaces extending from the grip face to an apex, one of the inclined surfaces being shorter than the other inclined surface, wherein the ridged shape is configured to provide enhanced gripping with balls of fingertips of at least third to fifth fingers of a user's hand holding the handgrip in one of the circumferential directions of the handgrip as compared to holding the handgrip in another direction of the circumferential directions, wherein the plurality of ribs are arranged on at least one of a left circumferential side and a right circumferential side of the handgrip such that the longitudinal dimension of a rib that is located at a forward position along the circumferential side of the handgrip is longer than the longitudinal dimension of a rib that is located at a comparatively more rearward position along the circumferential side of the handgrip, and wherein the cushion is arranged on the handgrip to extend continuously at least from the forwardly positioned rib to the rearwardly positioned rib, such that the cushion spans the forwardly positioned rib and the rearwardly positioned rib and the space therebetween.

12. The power tool as defined in claim 1, wherein the ridged shape is configured to engage with the ball of fingertips of at least third to fifth fingers of the user's hand holding the handgrip in said one of the circumferential directions of the handgrip and is configured to be comparatively more difficult to engage with the ball of fingertips of at least third to fifth fingers of user's hand holding the handgrip in said another direction of the circumferential directions.

13. The power tool as defined in claim 11 wherein the longitudinal dimensions of the ribs become progressively longer toward the forward position along the circumferential side of the handgrip.

14. A power tool that performs a predetermined operation by driving a tool bit comprising:

a tool body having a tool bit end located in a forward position;

a handgrip formed on the tool body, the handgrip having a shell made of a relatively hard material, and having an outer cushion made of a relatively softer material that is provided around at least a portion of the shell on the handgrip for engaging a user's fingers, a grip face provided on a circumferential surface of the handgrip and a plurality of ribs that are formed in parallel as a part of the cushion on the grip face to protrude from the grip face, each rib being elongate and having a longitudinal dimension extending in the longitudinal direction of the handgrip that is greater than a circumferential dimension extending in the circumferential direction of the handgrip, wherein each rib extends on the grip face in a longitudinal direction of the handgrip, each rib has a ridged shape that is configured to provide enhanced gripping with balls of fingertips of at least third to fifth fingers of a user's hand holding the handgrip in one of the circumferential directions of the handgrip as compared to holding the handgrip in another direction of the circumferential directions, and each rib has a triangular shaped cross section and the triangular shape has sides formed by inclined surfaces extending from the grip face to an apex, one of the inclined surfaces being shorter than the other inclined surface, wherein the handgrip includes a first circumferential portion having a first set of ribs oriented such that each rib in the first set provides the enhanced gripping in a first circumferential direction of the handgrip as compared to a second circumferential direction that is opposite the first circumferential direction, and the handgrip includes a second circumferential portion having a second set of ribs oriented such that each rib in the second set provides the enhanced gripping in the second circumferential direction of the handgrip as compared to the first circumferential direction, wherein the plurality of ribs are arranged on at least one of a left circumferential side and a right circumferential side of the handgrip such that the longitudinal dimension of a rib that is located at a forward position along the circumferential side of the handgrip is longer than the longitudinal dimension of a rib that is located at a comparatively more rearward position along the circumferential side of the handgrip, wherein the cushion is arranged on the handgrip to extend continuously at least from the forwardly positioned rib to the rearwardly positioned rib, such that the cushion spans the forwardly positioned rib and the rearwardly positioned rib and the space therebetween, and a portion of the shell at a rearward position on the handgrip along the circumferential side is not covered by the cushion.

15. The power tool as defined in claim 14, wherein the first set of ribs are positioned and configured to engage with the balls of fingertips of at least third to fifth fingers of the user's right hand gripping the handgrip, and the second set of ribs are positioned and configured to engage with the ball of fingertips of at least third to fifth fingers of the user's left hand gripping the handgrip.

16. The power tool as defined in claim 14, wherein the longitudinal dimensions of the ribs become progressively longer toward the forward position along the circumferential side of the handgrip.

* * * * *